US009022482B2

(12) United States Patent
Morio et al.

(10) Patent No.: US 9,022,482 B2
(45) Date of Patent: May 5, 2015

(54) STRETCHING STRUCTURE OF A TENSION MEMBER FOR A CHAIR

(75) Inventors: Sayaka Morio, Kanagawa (JP); Ryo Igarashi, Kanagawa (JP)

(73) Assignee: Okamura Corporation (JP)

( * ) Notice: Subject to any disclaimer, the term of this patent is extended or adjusted under 35 U.S.C. 154(b) by 33 days.

(21) Appl. No.: 13/983,358

(22) PCT Filed: Jan. 25, 2012

(86) PCT No.: PCT/JP2012/051571
§ 371 (c)(1),
(2), (4) Date: Aug. 2, 2013

(87) PCT Pub. No.: WO2012/105390
PCT Pub. Date: Aug. 9, 2012

(65) Prior Publication Data

US 2013/0307311 A1 Nov. 21, 2013

(30) Foreign Application Priority Data

Feb. 2, 2011 (JP) ..... 2011-020317

(51) Int. Cl.

| | |
|---|---|
| ***A47C 31/02*** | (2006.01) |
| ***A47C 7/02*** | (2006.01) |
| ***A47C 7/40*** | (2006.01) |
| ***A47C 3/023*** | (2006.01) |
| *A47C 7/28* | (2006.01) |

(52) U.S. Cl.
CPC . *A47C 7/40* (2013.01); *A47C 7/282* (2013.01); *A47C 3/023* (2013.01); *A47C 31/023* (2013.01)

(58) Field of Classification Search
CPC ..... A47C 3/023; A47C 7/40; A47C 7/282; A47C 31/023
USPC ..... 297/452.18, 452.56, 440.15, 447.4, 297/448.2, 450.1
See application file for complete search history.

(56) References Cited

U.S. PATENT DOCUMENTS

| | | | | |
|---|---|---|---|---|
| 6,942,300 | B2 * | 9/2005 | Numa et al. | 297/452.56 |
| 7,837,272 | B2 * | 11/2010 | Masunaga et al. | 297/452.56 |
| 8,777,321 | B2 * | 7/2014 | Masunaga et al. | 297/452.56 |

FOREIGN PATENT DOCUMENTS

| | | | |
|---|---|---|---|
| JP | 07-37552 | U | 8/1995 |
| JP | 4108322 | B | 6/2003 |
| JP | 2004/113503 | A | 4/2004 |
| JP | 2005/118439 | A | 5/2005 |
| JP | 2006-271622 | A | 10/2006 |
| JP | 2007-289705 | A | 8/2007 |

* cited by examiner

*Primary Examiner* — Chi Q Nguyen
(74) *Attorney, Agent, or Firm* — Skinner and Associates; Joel Skinner

(57) ABSTRACT

An engagement protrusion (20) extending in the front/back direction of a frame body (13) is provided on one of the opposing surfaces of a notch (16) in the frame body (13) and a fitting member (17) opposite said notch; similarly, an engagement recess (13*h*) in which the engagement protrusion (20) fits is provided on the other of said surfaces. By means of the moment of the fitting member (17) resulting from the tension of a tension member (14), the engagement protrusion (20) and the engagement recess (13*h*) are prevented from separating.

6 Claims, 12 Drawing Sheets

STRETCHING STRUCTURE OF A TENSION MEMBER FOR A CHAIR

TECHNICAL FIELD

The present invention relates to the stretching structure of a tension member for a chair.

BACKGROUND OF THE INVENTION

Recently in office chairs used in working spaces or meeting rooms of an office, the back of a user is supported by the backrest over which elastic covering material or a tension member is stretched. In the backrest of the chair, a front surface of a back frame molded in a closed loop of metal such as Al which can easily be molded or synthetic resin is covered with the tension member. The circumference of the tension member is attached to the back surface or side of the back frame and the tension member is stretched over the back frame in Patent Literature 1.

Meanwhile, there is a great demand for a cantilever-type chair in which the backrest is connected to a leg frame made of pipes. The chair provides the armrest at part in which the backrest is connected to the leg frame in Patent Literatures 2-4.

In the chair with the armrest, the middle of the back frame is connected to the rear ends of the armrests. The seat is supported by a seat support in the middle of front legs of the leg frame.

PRIOR ART

Patent Literature

Patent Literature 1: JP4061160B2
Patent Literature 2: JP7-37552Y2
Patent Literature 4: JP2007-289705A

Problems to be Solved by the Invention

However, in the conventional cantilever-type chair with the armrest, a projection on the front surface of the back frame of the backrest is connected to the leg frame. A hole through which the projection passes is formed in the tension member, and the circumference of the tension member engages with the rear surface of the back frame or side groove. The hole is exposed, so that its appearance becomes poor.

The projection projects outward and sideward of the back frame and a groove of the back frame is formed on the front surface. However, a die-drawing direction for opening the groove is crossed with a die-drawing direction for forming the projection, thereby disabling it to be molded once by the same die. The molding increased by one step, so that the operation is complicated to increase the costs. Such problem occurs not only in the backrest connected to the leg frame but also in the backrest connected to the seat.

In order to solve the problem, the applicant provides in JP2011-161049A (Appln. No. 2010-27957) the stretching structure of a tension member for a chair in which the tension member is stretched over a closed-loop frame and an ear for connection to another member of the chair is provided on the circumference of the frame close to the back surface, wherein a recess is formed on the front surface of the projection and an engagement member fits in the recess, a groove being formed on the outer circumferential surface of the frame close to the ear and on the outer circumferential surface of the engagement member, a circumference of the tension member fitting in the groove.

However, in the stretching structure of the tension member for a chair, the engagement member fits in the recess of the frame with a screw. The screw arrangement is complicated, and when the chair is taken to pieces for disposal of wastes, it is necessary to remove the screw, which is complicated.

In view of the disadvantages in the prior art, it is an object of the invention to provide the stretching structure of a tension member for a chair in which an engagement member can easily be attached to and removed from a frame without a screw, a tension member being easily stretched and separated for disposal of wastes, wherein the engagement member cannot be taken off the frame in use of the chair.

It is another object of the invention to provide a chair in which a frame over which a tension member is stretched is connected to another member of the chair, wherein the frame can easily be drawn when the frame is molded to facilitate molding of the frame, the tension member can be prevented from loosening, its appearance is good and the costs can be saved.

Hence, the recess is formed at part closer to the front surface than the ear, and it is not necessary to form a groove on the outer circumferential surface of the part. Thus, a die-drawing direction for forming a groove on the outer circumferential surface of the frame is not crossed with a die-drawing direction for forming the ear thereby facilitating die-drawing in molding of the frame and easily molding the frame at a single step by a simple die to save the costs. The circumference of the tension member engages in the grooves on the outer circumferential surfaces of the engagement member and frame, so that the tension member can be stretched over the front surface of the frame securely without loosening with good appearance. It is not necessary to form a through-hole for putting through the ear of the frame, so that strength of the tension member can be kept with good appearance.

Advantages of the Invention

According to the present invention, the engagement member can easily be attached to and removed from the frame without a screw thereby facilitating stretching of the tension member and separation for disposal of wastes. In use of the chair, the engagement member is not taken off the frame in the stretching structure of the tension member for a chair. According to the present invention, there is provided the stretching structure for a tension member for a chair in which, in a chair in which the frame over which the tension member is stretched is connected to another member, die-drawing is easily performed in molding of the frame and the frame can easily be molded without loosening of the tension member with good appearance to save the costs.

DETAILED DESCRIPTION OF THE DRAWINGS

Embodiments of the present invention will described with respect to appended drawings.

Figure 1:
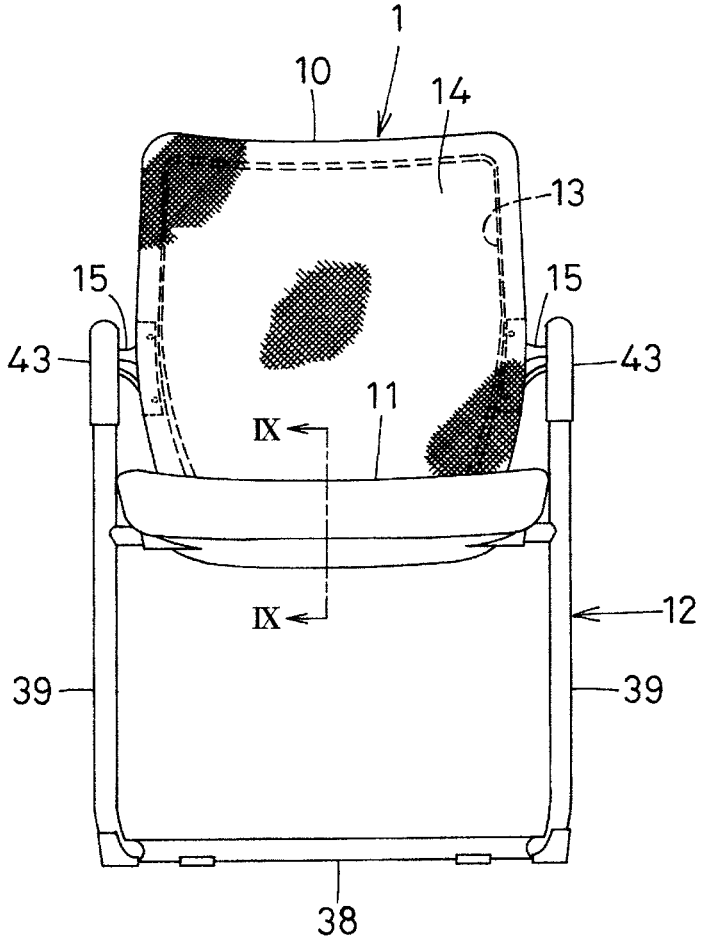
FIG. 1 is a front elevational view of a chair comprising the first embodiment of the present invention.
Figure 2:
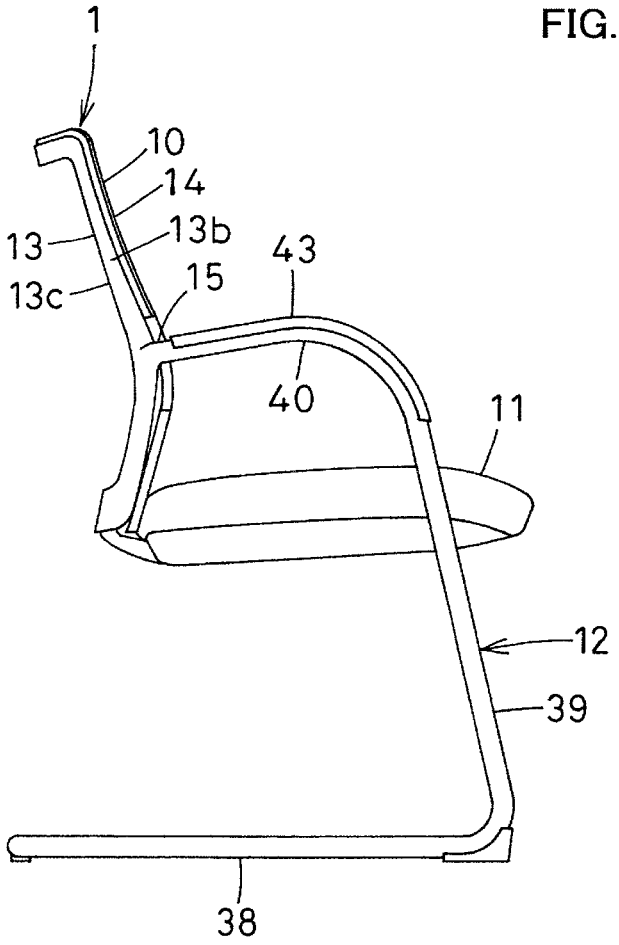
FIG. 2 is a side elevational view thereof.

FIGS. 1 to 9 illustrate the first embodiment of the backrest of a chair to which the present invention is applied. FIG. 1 is a front elevational view of the chair comprising the first embodiment of the present invention, and FIG. 2 is a side elevational view thereof.

Figure 3:
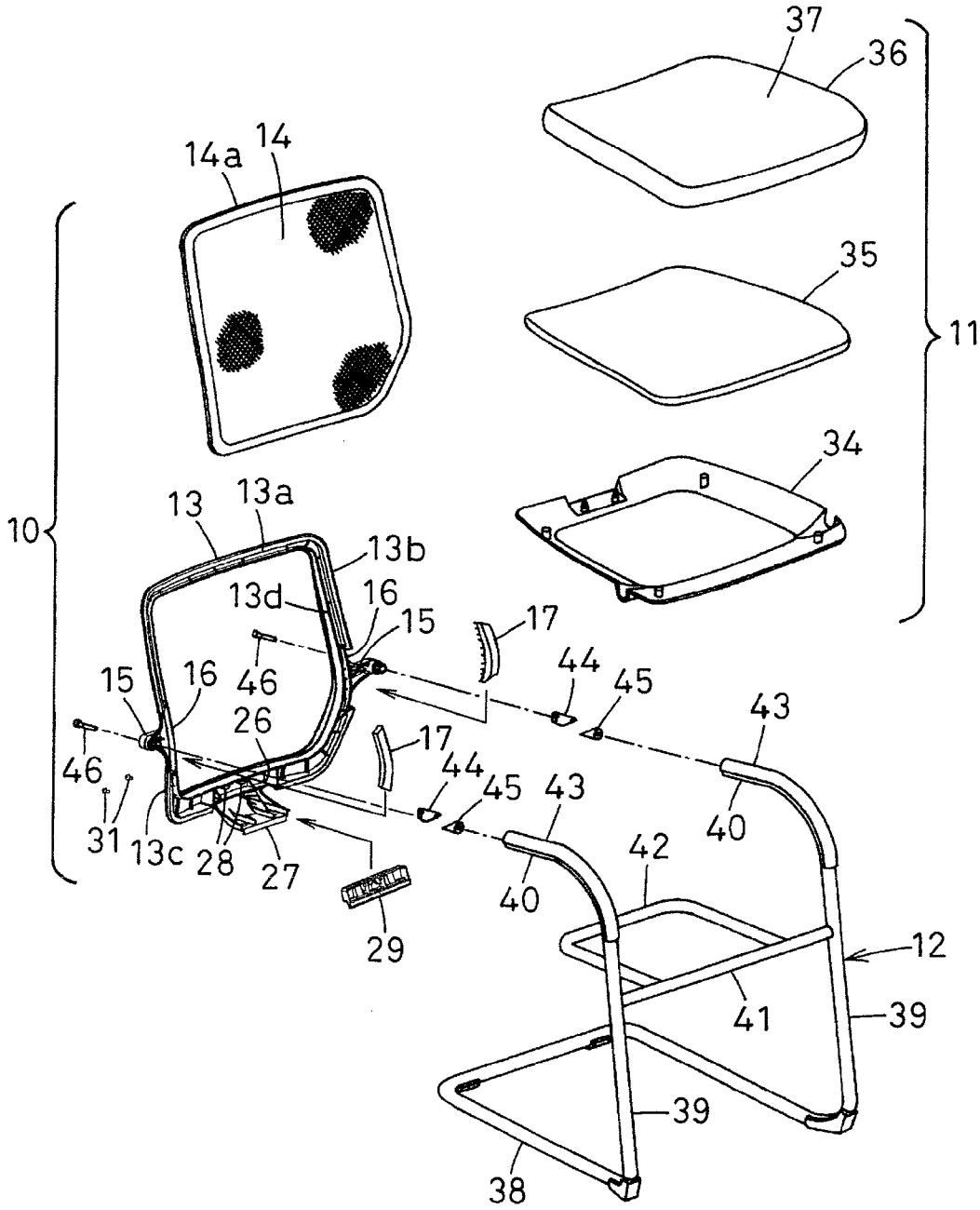
FIG. 3 is an exploded front perspective view thereof.

The chair 1 comprises a backrest 10, a seat 11 and a leg frame 12 supporting the backrest 10 and seat 11. In FIG. 3, the backrest 10 comprises a closed-loop frame 13, and tension member 14 stretched over the front surface 13*a* of the frame 13.

The tension member 14 is elastically formed in mesh. A circumference 14*a* of the tension member 14 is formed like a bag in which elongate elastic-synthetic-resin edge member 14*b* is disposed in FIG. 7. The edge member 14*b* may directly be sewn or fixed to the circumference 14*a*.

A pair of ears 15,15 for connecting the frame 13 to the leg frame 12 is provided on an outer side surface 13*b* close to a back surface 13*c* of the frame 13.

Figure 4:
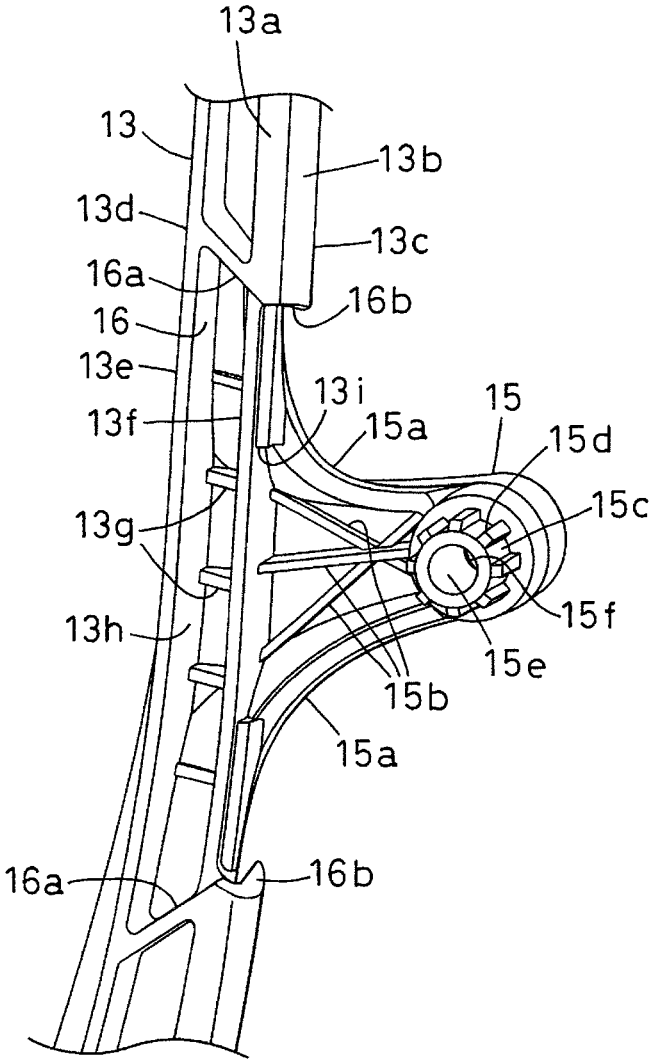
FIG. 4 is an enlarged perspective view of a groove of a frame when viewed from the right side.

In FIG. 4, on the upper and lower parts of the ear 1, there are reinforcement ribs 15*a*,15*a* which gradually enlarge toward the frame 13. Each of the ears 15 is open at the front surface in which a plurality of reinforcement ribs 15*b* is crossed to one another.

A boss 15*c* which faces the front is provided on the end of the each of the ears 15. A plurality of splines 15*d* is provided on the outer circumferential surface of the boss 15*c*. In the boss 15*c*, there is formed a blind hole 15*e* which faces the front of the frame 13. At the bottom of the blind hole 15*e*, in FIG. 5, there is formed a through hole 15*f*. In FIG. 3, the structure of the ear 15 is provided so that the ear 15 may be connected to an armrest 40 (later described) of the leg frame 12.

In FIGS. 3 and 4, there are formed vertical recesses 16,16 the depth of which is substantially equal to the base of the ear 15 close to the front surface 13*a* in front of the ear 15 of the frame 13. The recess 16 of the frame 13 is vertically straight at the upper part and is slightly curved inward at the lower part.

In FIG. 4, close to the inner side surface 13*d* and outer side surface 13*b* of the frame 13, a pair of vertical projections 13*e*,13*f* toward the front surface 13*a* of the frame 13 is continuously formed with the upper and lower edges of the recess 16 respectively.

The projection 13*e* of the inner side surface 13*d* of the frame 13 is continuous with the inner side surface 13*d* and the front surface 13*a* of the frame 13. The protrusion 13*f* of the outer side surface 13*b* is disposed inward of the recess 16 than the outer side surface 13*b* and the front surface 13*a* of the frame 13.

A plurality of horizontal reinforcement ribs 13*g* is vertically spaced between the projection 13*e* and the protrusion 13*f* at the rear of the recess 16. An engagement groove 13*h* extends longitudinally of the frame 13 between the projections 13*e* and 13*f* from the front ends of the projections 13*e*, 13*f* to the front edge of the reinforcement rib 13*g*. An opening 13*i* is formed forward of the ear 15 outside the protrusion 13*f* of the recess 16 of the frame 13.

The upper and lower edges of the recess 16 comprise tilted surfaces 16*a*,16*a* so that a vertical distance between the tilted surfaces 16*a* and 16*a* gradually becomes shorter outward, and horizontal surfaces 16*b*,16*b* extending outward from the tilted surfaces 16*a*,16*a*.

Figure 5:
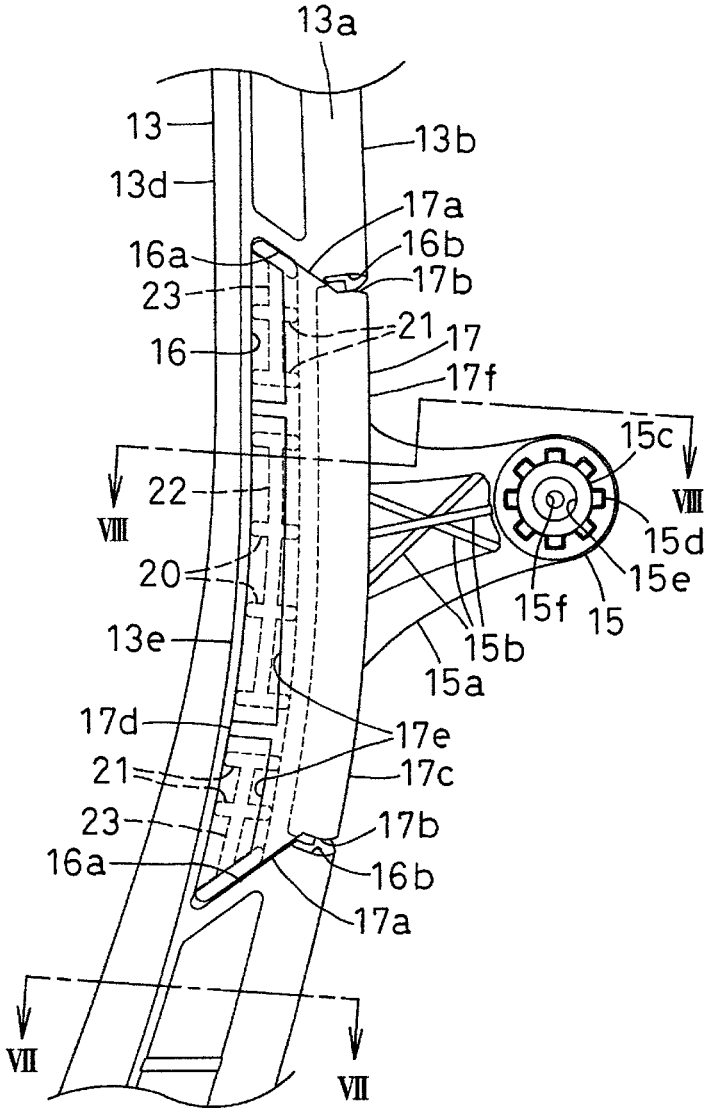
FIG. 5 is an enlarged front elevational view of the frame when an engagement member engages with the groove.
Figure 6:
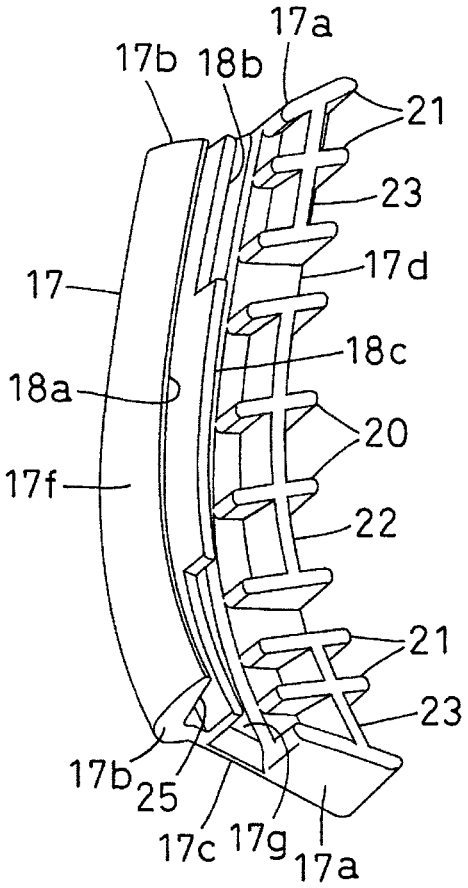
FIG. 6 is a perspective view of the engagement member when viewed from a left lower back.

In FIGS. 3, 5 and 6, an engagement member 17 fits in each of the right and left recesses 16. The engagement member 17 is substantially complementary with the recess 16. Specifically, the engagement member 17 is straight at the upper part; is slightly curved inward at the lower part; and comprises a dovetail portion complementary with a dovetail groove between the upper and lower tilted surfaces 16*a* and 16*a* of the recess 16 and a rectangular portion which fits between the horizontal surfaces 16*b* and 16*b* of the recess 16. The upper and lower ends of the engagement member 17 comprise tilted surfaces 17*a*,17*a* facing upper and lower tilted surfaces 16*a*, 16*a* of the recess 16; and horizontal surfaces 17*b*,17*b* facing the upper and lower surfaces 16*b*,16*b* of the recess 16.

Part between the horizontal surfaces 16*b* and 16*b* of the recess 16 is open to the front and back surfaces and outer side, and the dovetail groove is open only to the front surface. The rectangular portion of the engagement member 17 which fits between the horizontal surfaces 16*b* and 16*b* is exposed to the front and back sides and outer side. The dovetail portion which fits in the dovetail groove of the recess 16 is exposed only to the front surface of the frame 13.

Figure 8:
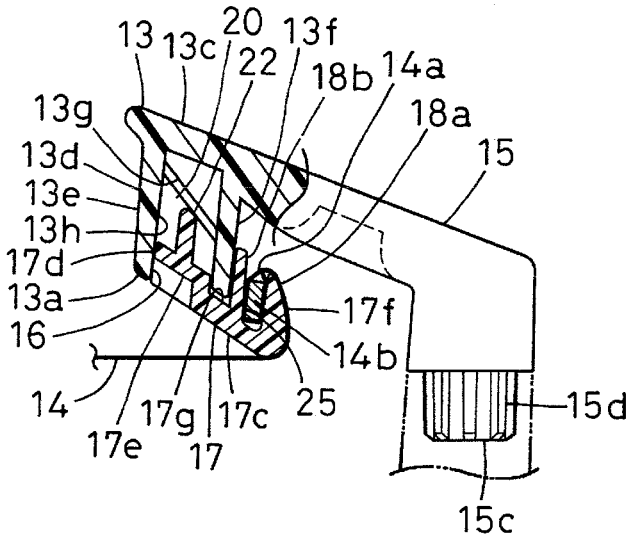
FIG. 8 is a horizontal sectional plan view taken along the line VIII-VIII in FIG. 5.

In FIGS. 5 and 8, a plurality of lightening openings 17*e* is vertically spaced in the front surface 17*c* of the engagement member 17 near the inner side surface 17*d*. The front surface 17*c* and the outer side surface 17*f* of the engagement member 17 is continuously formed with the front surface 13*a* and the outer side surface 13*b* of the frame 13. The inner side surface 17*d* of the engagement member 17 is in contact with or is close to the outer side surface of a protrusion 13*e* of an inner side surface 13 of the recess 16.

In FIG. 6, a pair of vertical protrusions 18*a*,18*b* in parallel with each other is provided on the back surface of the rectangular portion 17 near the outer side surface 17*f*. Both the protrusions 18*a*,18*b* extend from the upper end to the lower end of the engagement member 17.

In the middle of the inner protrusion 18*b*, there is provided a projection 18*c* which fits in the opening 13*i* of the recess 16 of the frame 13.

A plurality of engagement projections 20,21 is spaced vertically to fit in the engagement groove 13*h* of the recess 16 of the frame 13 on the back surface of the engagement member 17 near the inner side surface 17*d*.

In FIGS. 6 and 8, the length of the engagement projections 20,21 gradually becomes smaller from the inner side surface 17*d* to the outer side surface 17*f* of the engagement member 17. The engagement projections 20 are connected to each other in the middle by a connecting portion 22, and the engagement portion 21 are connected to each other by a connecting portion 23.

Between the engagement projections 20,21 and the inner protrusion 18*b*, a vertical groove 17*g* is formed to fit with the protrusion 13*f* in the recess 16 of the frame 13.

Figure 7:
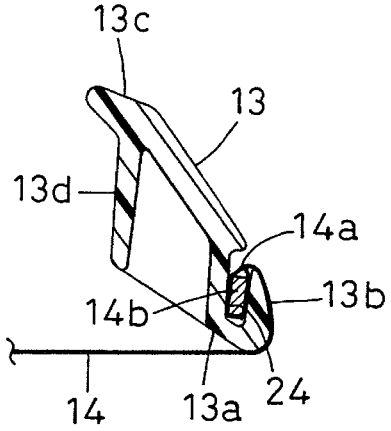
FIG. 7 is a horizontal sectional plan view taken along the line VII-VII in FIG. 5.

In FIG. 7, on the whole circumference of the frame 13 except the recess 16, there is formed a groove 24 for attaching the circumference of the tension member 14.

On the back surface of the rectangular portion of the engagement member 17, the groove 25 is formed between the protrusions 18*a* and 18*b* and communicates with the groove 24 of the frame 13. In this embodiment, the grooves 24,25 are open backward around the frame 13 and engagement member 17, but may be open toward the outer side.

The engagement projections 20,21 of the engagement member 17 fits in the engagement groove 13*h* of the recess 16 of the frame 13. The protrusion 13*f* of the recess 16 of the frame 13 fits in the groove 17*g*. Hence, the front surface 17*c* and outer side surface 17*f* are coplanar with the front surface 13*a* and the outer side surface 13*b* and the groove 25 is continuous with the groove 24 of the frame 13.

After the engagement member 17 is fitted in the recess 16 of the frame 13, the circumference 14*a* of the tension member 14 is fitted with the edge member 14*b* into the groove 24 of the frame 13 and the groove 25 of the engagement member 17 by force and attached in FIGS. 7 and 8. Hence, the tension member 14 is stretched over the surface of the frame 13 and the engagement member 17.

When the tension member 14 is stretched over the surface of the frame 13 and the engagement member 17, the outer front part of the engagement member 17 intends to turn inward of the frame 13 around the inner rear part. Moment of the engagement member 17 increases frictional force between the engagement projections 20,21 and engagement groove 13*h* to cause stick phenomenon thereby preventing the engagement member 17 from leaving the frame 13.

When the protrusion 13*f* of the frame 13 as second engagement projection fits in the groove 17*g* of the engagement member 17 as second engagement groove, frictional force increases at the engagement to prevent the engagement member 17 from leaving the frame 13 even if moment of the engagement member 17 acts to the engagement portion.

Furthermore, the circumference 14*a* and edge member 14*b* of the tension member 14 are continuously fitted and attached in the grooves 24,25 in the outer circumferences of the frame 13 and engagement member 17, so that the circumference 14*a* of the tension member 14 is unlikely to leave the grooves 24,25, and a force for preventing the engagement member 17 from leaving the frame 13 is assisted.

Thus, without attaching means such as a screw, the engagement member 17 merely fits in the recess 16 of the frame 13 thereby ensuring easy engagement and facilitating stretching of the tension member 14.

In order to separate the frame 13 from the tension member 14 to get rid of chairs, for example, the tension member 14 is pulled off without loosening attaching means such as a screw thereby easily separating the engagement member 17 from the frame 13 and facilitating separation for disposal of wastes.

Figure 9:
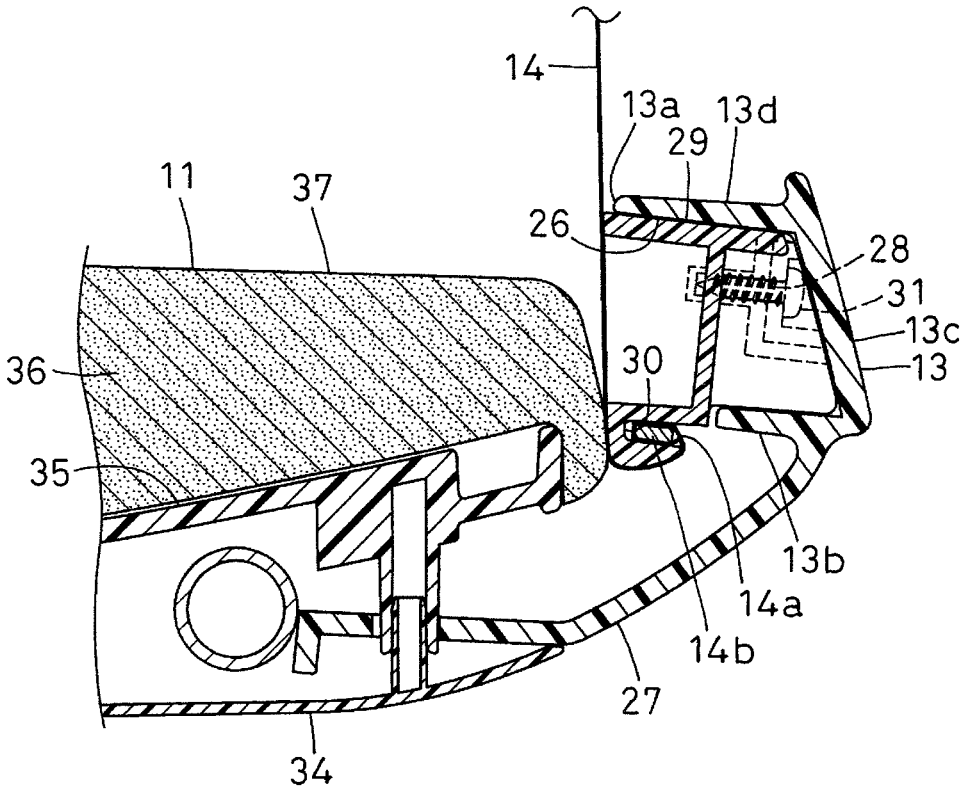
FIG. 9 is an enlarged vertical sectional plan view taken along the line IX-IX in FIG. 1.

In FIGS. 3 and 9, a rectangular recess 26 is formed in the middle of the front surface 13*a* at the lower part of the frame 13, and a lower connector 27 is provided as projection for connection with the seat 11 near the back surface 13*c* from the recess 26.

The recess 26 is formed in front of the lower connecting portion 27 closer to the front surface 13*a*. The right and left side ends of the recess 26 are parallel vertically. The bottom of the recess 26 has a screw-through hole 28.

In FIG. 9, the engagement member 29 fits in the recess 26. The engagement member 29 is substantially complementary with the recess 26 when viewed from the front. The engagement member 29 is open forward. On the lower circumference of the engagement member 29, there is formed a groove 30 which communicates with the groove 24 on the outer circumference of the frame 13 and open backward.

When the groove 30 communicates with the groove 24 of the frame 13 and the engagement member 29 fits in the recess 26 of the frame 13, the engagement member 29 is fixed to the frame 13 with a screw 31 which is put into the screw-through hole 28 from the back of the frame 13.

After the engagement member 29 is fixed to the frame 134, the circumference of the tension member 14 is fitted with and attached to the edge member 14*b* in such a manner that the engagement member 17 is fitted in the groove 25.

In the engagement member 29 and the recess 26 of the frame 13, what are similar to the engagement projections 20,21 of the engagement member 17 and engagement groove 13*h* of the recess 16 are provided thereby preventing the engagement member 29 from leaving the recess 26 by moment of the engagement member 29 resulting from tension of the tension member 14. Thus, the screw 31 may be omitted.

In FIG. 3, the seat 11 comprises a rectangular closed-loop frame 34; a seat shell 35 attached to the frame 34; a seat cushion 36 attached to the seat shell 35; and a tension member 37 stretched over the surface of the seat cushion 36.

In FIGS. 2 and 3, the leg frame 12 comprises a U-like leg base 38; a pair of front legs 39,39; and armrests 40,40 horizontally extending from the upper ends of the front legs 39,39.

The front legs 39,39 are connected to each other in the middle via a cross beam 41. A U-shaped support 42 for supporting the seat 11 projects backward. Synthetic-resin arm pads 43,43 are provided over the armrests 40,40. The leg frame 12 may preferably be a double-pipe structure partially or totally to improve the strength.

In FIG. 3, the ear 15 of the frame 13 is connected to the armrest 40 of the leg frame 12 with screws 46 in screw seats 44,45 disposed in the armrest 40 of the leg frame 12.

In FIGS. 5 and 9, in order to stretch the tension member 14 over the surface of the frame 13 of the backrest 10, the engagement members 17,17 and engagement member 29 are fitted into the right and left grooves 16,16 and the lower recess 26 of the frame 13 respectively. The lower engagement member 29 is attached to the frame 13 with the screw 31.

Then, the surface 13*a* of the frame 13 is covered with the tension member 14 the circumference 14*a* of which is pulled toward the back surface 13*c* along the outer side surface 13*b* of the frame 13. The circumference 14*a* and the edge member 14*b* are engaged and fixed in the outer circumferential groove 24 of the frame 13, the groove 25 of the engagement member 17 and the groove 30 of the engagement member 29 while facing the front. Each of the engagement members 17 may preferably be engaged in the recess 16 of the frame 13 while the circumference 14*a* of the tension member 14 and edge member 14*b* fits in the groove 25 of the engagement member 17.

When the tension member 14 is stretched over the surface 13*a* of the frame 13, each of the engagement members 17 will become unlikely to leave the frame 13 by moment of the tension member 14. Thus, the engagement member 17 can securely be attached in the recess 16 of the frame 13 without attaching means such as a screw, thereby facilitating stretching of the tension member 14.

When the frame 13 is separated from the tension member 14 to get rid of the chair, the engagement member 27 can easily be separated from the frame 13 without loosening attaching means such as a screw thereby facilitating separation of the tension member 14.

Furthermore, it is not necessary to provide the groove 24 in front of the ear 15 and lower connector 27 of the frame 13. Thus, when the frame 13 is molded, a die-drawing direction for forming a groove in the outer side surface 13*b* of the frame 13 is not crossed with a die-drawing direction for forming the frame 13 thereby facilitating molding of the frame 13. The frame 13 is easily molded by a single step by a simple die thereby saving the costs.

The tension member 14 covers the outer side surface 17*f* and front surface 17*c* of the engagement member 17 and outer side surface and front surface of the engagement member 29 thereby improving the appearance of the backrest.

It is not necessary to form a through hole in the ear 15 of the frame 13 thereby maintaining the strength of the tension member 14 and improving its appearance.

The engagement projections 20 of the engagement member 17 are provided in the plural number longitudinally of the engagement member 17 and are connected by the connecting portion 22 thereby increasing strength of the engagement projections 20 and engagement member 17 to enable the engagement member 17 to get smaller.

In the recess 16 of the frame 13 and the ends of the engagement member 17, the length of the frame 13 gradually becomes smaller outward by the tilted surfaces 16*a*,17*a* thereby preventing the engagement member 17 from dropping out of the frame 13.

The engagement member 17 can be molded in a line separate from the die molding line of the frame 13 or by injection molding to save the costs. When the chair is thrown away or when the tension member 14 is replaced, the engagement member 17 can easily be taken off the recess 16 of the frame 13 thereby facilitating the replacement and separate disposal of wastes.

FIGS. 10 to 14 illustrate the second embodiment in which the present invention is applied to the backrest of a chair. The same numerals are allotted to the same members and portions in the first embodiment in FIGS. 1 to 9 and detailed description thereof is omitted.

Figure 10:
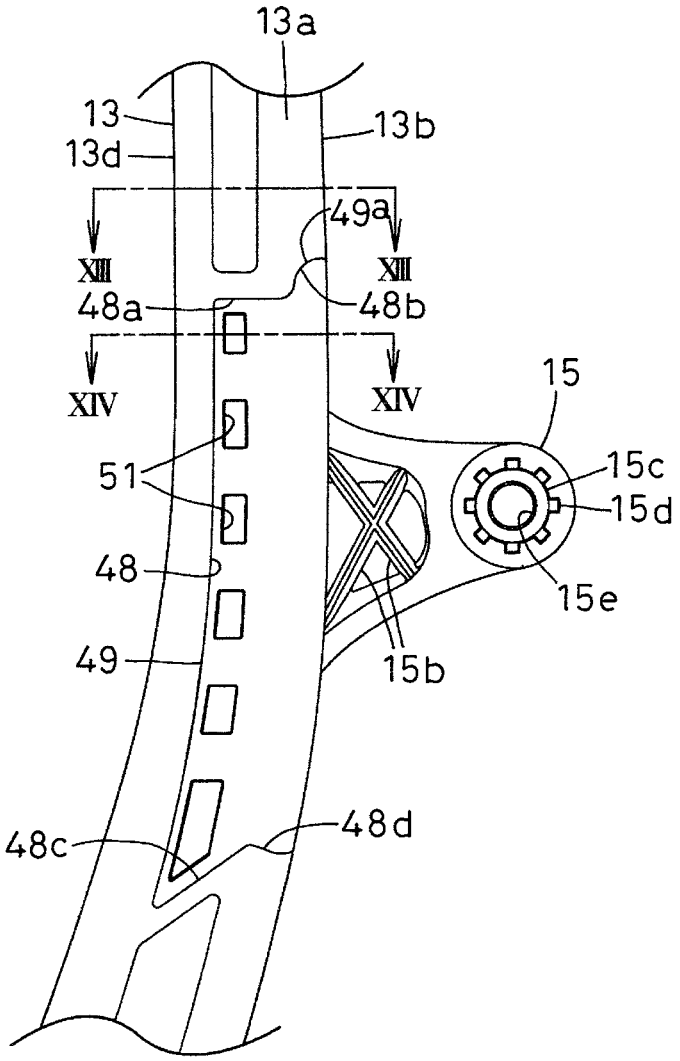
FIG. 10 is an enlarged front view of part of the frame when an engagement member engages in a recess in the second embodiment.
Figure 11:
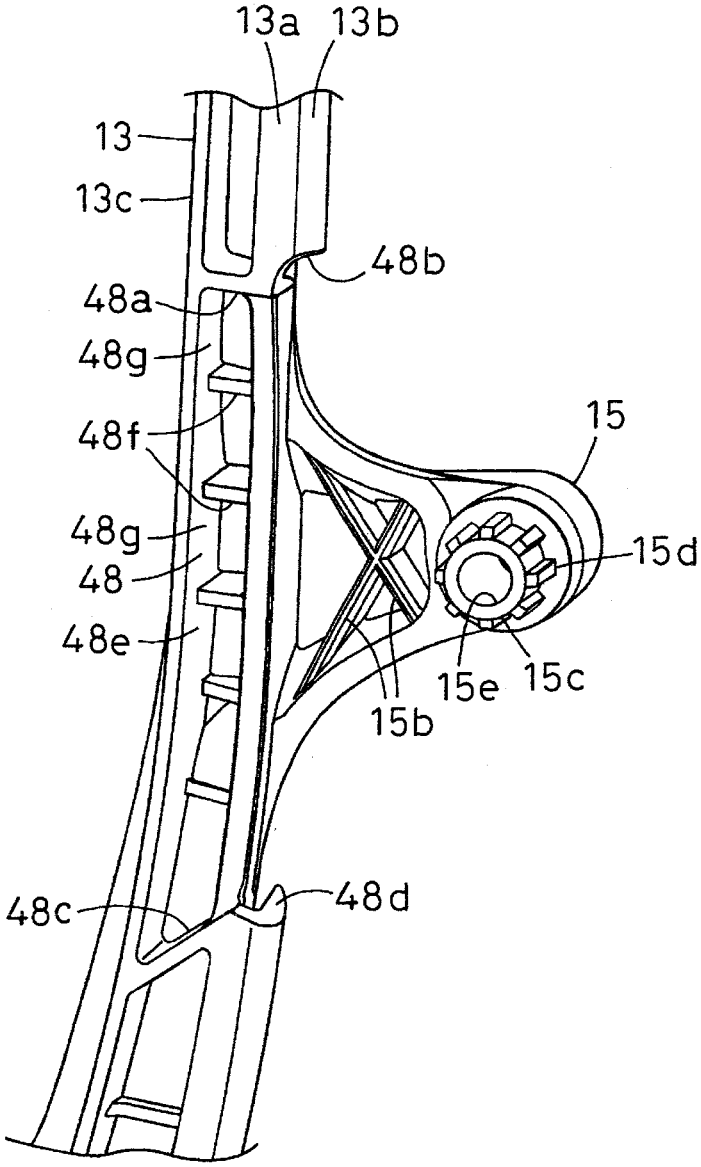
FIG. 11 is an enlarged front perspective view of the recess in the frame when the engagement member is removed.

In FIGS. 10 and 11, in the second embodiment, the upper end of a recess 48 comprises a horizontal surface 48*a* and an enlarged portion 48*b* which enlarges like an arc and is open to the outside. The lower end of the recess 48 comprises a tilted surface 48*c* similar to the tilted surface 16*a* of the recess 16 in the first embodiment, and a horizontal surface 48*d* which is open to the outside. The horizontal surface 48*d* is like an arc of a circle the center of which is positioned above.

In FIG. 11, in the recess 48, there is a vertically elongate engagement recess 48*e* similar to the engagement groove 13*h* of the recess 16 in the first embodiment. In the engagement recess 48*e*, a plurality of reinforcement ribs 48*f* is horizontally disposed and vertically spaced from one another. The engagement recess 48*e* is partitioned by the reinforcement ribs 48*f*. In the embodiment as shown, seven rectangular holes 48*g* are formed.

In FIG. 10, an engagement member 49 which fits in the recess 48 is complementary to the recess 48 in the front surface. An arc-shaped projection 49*a* fits in the enlarged surface 48*b*.

Figure 12:
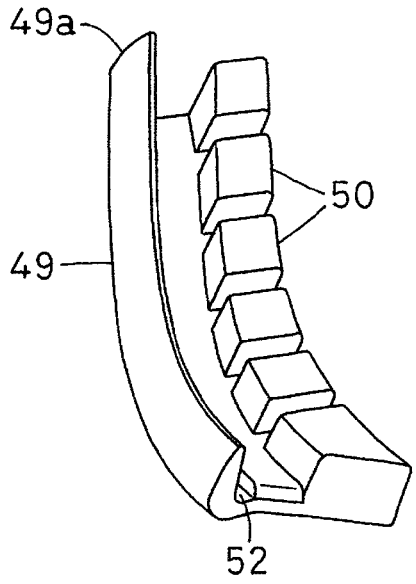
FIG. 12 is a back perspective view of the engagement member in the second embodiment.
Figure 13:
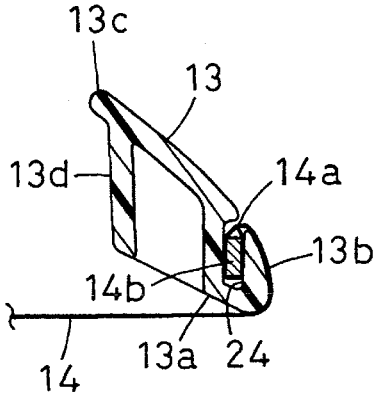
FIG. 13 is an enlarged horizontal plan view taken along the line XIII-XIII in FIG. 10.
Figure 14:
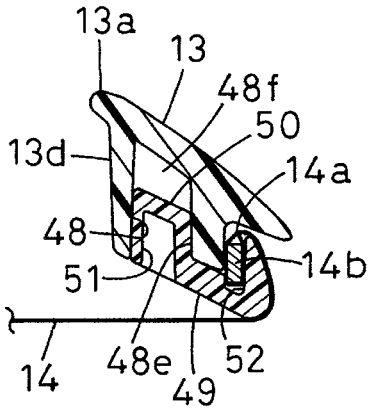
FIG. 14 is an enlarged horizontal plan view taken along the line XIV-XIV in FIG. 10.

In FIG. 12, on the back surface of the engagement member 49, a plurality of rectangular engagement projections 50 is vertically spaced from one another to fit in rectangular holes 48*g* of the engagement recess 48*e* of the frame 13. In this embodiment, the engagement projections 50 comprise seven.

On the front surface of the engagement member 49, a plurality of lightening openings 51 is formed to make the engagement projections 50 hollow respectively.

On the outer circumference of the engagement member 49, there is formed a groove 52 similar to the groove 25 of the engagement member 17 in the first embodiment. The groove 52 is continuous with the groove 24 of the frame 13 when the engagement member 49 fits in the recess 48.

In the second embodiment, the rectangular engagement projections 50 fit in the rectangular grooves 48*g* of the engagement recess 48*e* respectively, and the engagement member 49 fits in the recess 48 of the frame 13. The circumference 14*a* of the tension member 14 is pressingly fitted in the groove 24 of the frame 13 and the groove 52 of the engagement member 49 continuously. By moment of the engagement member 49 resulting from tension of the tension member 14, the engagement member 49 does not leave the frame 13. Similar function and advantages to the first embodiment can be achieved.

The rectangular engagement projection 50 of the engagement member 49 engages in the rectangular groove 48*g* of the engagement recess 48*e* of the recess 48 thereby not only facilitating molding of the frame 13 and engagement member 49 but also ensuring that the engagement member 49 is exactly positioned with respect to the frame 13 to prevent the engagement member from deviation.

Furthermore, at one end of the recess 48 of the frame 13, the arc-shaped enlarged portion 48*b* is provided and the projection 49*a* complementary to the enlarged portion 48*b* is provided at the corresponding part of the engagement member 49. Hence, when the engagement member 49 fits into the recess 48 of the frame 13, damage by contacting the corner of the engagement member 49 with the inner surface of the recess 48 can be prevented. When the user leans against the backrest 10, stress is prevented from gathering parts close to the recess 48 on the outer side surface 13*b* of the frame 13.

In the first and second embodiments, the present invention is applied to the backrest of a chair, but may be applied to the seat or headrest of a chair by modifying the direction and/or shape.

Various embodiments may be made without departing from the scope of claims:

(1) The groove 24 of the frame 13 and grooves 25,30,52 of the engagement member may be open to the outer side.

(2) The engagement projection 20 of the engagement member 17 may be provided on the recess 16, and the engagement groove 13*h* of the recess 16 may be provided on the engagement member 17.

(3) The tilted surfaces 16*a*,17*a* at the upper and lower ends of the recess 16 and the engagement member 17 may be made such that a vertical distance between the tilted surfaces 16*a* and 17*a* gradually becomes greater.

(4) At the upper and lower ends of the recess 16 and engagement member 17, an engagement projection and an engagement groove may be made instead of the tilted surfaces 16*a*,17*a*.

(5) In the lower recess 26 of the frame 16 and engagement member 29, an engagement projection and an engagement groove may be made as well as in the grooves 16 of the frame 13 and the engagement member 17 thereby omitting screw-attachment of the engagement member 29.

(6) At the right and left ends of the recess 26 and engagement member 29, there may be provided a tilted surface similar to that at each end of the recess 16 and engagement member 17.

(7) The present invention may be applied to case in which a projection is not provided in the recess 16.

What is claimed is:

1. A stretching structure of a tension member for a chair, the stretching structure comprising a frame having a recess on a front surface and a first groove in a first outer circumference, an engagement member engaged in the recess of the frame and having a second groove in a second outer circumference, the second groove communicating with the first groove of the frame, a tension member stretched over the front surface of the frame by inserting a circumference of the tension member into the first and second grooves, wherein an engagement projection is provided on one opposing surface of the recess of the frame and the engagement member, an engagement groove which engages with the engagement projection being formed in the other opposing surface, the engagement projection being prevented from leaving the engagement groove by movement of the engagement member resulting from tension of the tension member, and wherein there is provided an ear for connecting with another member of the chair on an outer circumferential surface of the frame, the recess being formed in the frame closer to the front surface than the ear, the engagement member fitting in the recess.

2. The structure of claim 1 wherein the engagement projection is provided on the engagement member and the engagement groove is formed on the frame.

3. The structure of claim 2 wherein a plurality of engagement projections are provided in parallel with one another longitudinally and connected by a longitudinally connecting portion.

4. The structure of claim 3 wherein in the recess of the frame, there is formed a dovetail groove in which an outer longitudinal distance is smaller than an inner longitudinal distance, part of the engagement member which engages in the dovetail groove being complementary with the dovetail groove.

5. The structure of claim 2 wherein an enlarged portion is formed at one end of the recess of the frame, and a projecting portion is formed on the engagement member to be complementary with the enlarged portion.

6. The structure of claim 1 wherein the engagement projection and engagement groove are rectangular.

* * * * *